US006449882B2

(12) United States Patent
Kono et al.

(10) Patent No.: US 6,449,882 B2
(45) Date of Patent: Sep. 17, 2002

(54) SNOW REMOVAL MACHINE

(75) Inventors: Masakatsu Kono, Wako (JP); Isao Yoshida, Wako (JP); Hiroshi Sueshige, Wako (JP); Norikazu Shimizu, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/754,644

(22) Filed: Jan. 4, 2001

(30) Foreign Application Priority Data

Jan. 12, 2000 (JP) ..... 2000-004080
Jan. 12, 2000 (JP) ..... 2000-004089

(51) Int. Cl.[7] ..... E01H 5/06

(52) U.S. Cl. ..... 37/266; 180/9.21; 180/9.22; 180/65.1

(58) Field of Search ..... 37/246, 248, 244, 37/249, 253, 266; 172/42, 811; 180/9.21, 9.22, 9.1, 216, 65.1, 900

(56) References Cited

U.S. PATENT DOCUMENTS 3,580,351 A * 5/1971 Mollen
4,023,287 A * 5/1977 De Brito
4,532,725 A * 8/1985 Trejo et al.
4,783,915 A * 11/1988 Sasaki et al.
5,018,592 A * 5/1991 Buchdrucker
5,020,250 A * 6/1991 Fuji et al.
5,064,011 A * 11/1991 Ogano et al.
6,035,561 A * 3/2000 Paytas et al.
6,129,166 A * 10/2000 Sueshige et al.
6,131,316 A * 10/2000 Yoshina et al.
6,170,179 B1 * 1/2001 Paytas et al.
6,173,799 B1 * 1/2001 Miyazaki et al.

FOREIGN PATENT DOCUMENTS

JP 60-18422 * 1/1985
JP 63293208 11/1988
JP 1-198910 * 8/1989
JP 2000-240026 * 9/2000
JP 2001-193030 * 7/2001
JP 2001-193031 * 7/2001

* cited by examiner

*Primary Examiner*—Victor Batson
(74) *Attorney, Agent, or Firm*—Adams & Wilks

(57) ABSTRACT

A walking-type snow removal machine comprises a snow removing member provided at a front part of a body frame for pushing snow forward, and crawler belts provided on right and left sides of the body frame. The body frame carries thereon an electric motor and a battery. The electric motor drives right and left drive wheels to drive the crawler belts. The electric motor generates little noise as compared with an engine, and contributes to downsizing of the snow removal machine. The battery supplies electrical power to the electric motor.

20 Claims, 13 Drawing Sheets

SNOW REMOVAL MACHINE

BACKGROUND OF THE INVENTION

1. Field of the Invention

The present invention relates to an improvement in a walking type snow removal machine which is self-propelled by power.

2. Description of the Related Art

In recent years, auger-type snow removal machines which are self-propelled by power and operated by operators walking with the machines have been extensively used to reduce the workload of the operators in clearing snow in a small area. An example of such auger-type snow removal machines is disclosed in, for example, Japanese Patent Laid-Open Publication No. SHO-63-293208 entitled "POWER TRANSMISSION DEVICE FOR SNOW REMOVAL MACHINE".

The disclosed snow removal machine comprises an auger and a blower provided at a front part of the body and handles provided at a rear part of the body. The auger, blower and right and left crawlers are driven by engine power provided via a transmission. The snow removal machine is of a walking type and is relatively small.

However, the snow removal machine is arranged such that snow raked in by the auger is thrown away with the blower through a shoot, thereby limiting a place to clear of snow. For example, there is a limit in using the auger-type snow removal machine in a small area such as a residential area in the suburbs or an urban district. Further, since it employs an engine as a power source, due care should be taken as to noises generated by the engine, especially when the auger-type snow removal machine is used at a quiet time, i.e., in an early morning or at midnight in a residential area or an urban district.

In this context, there has been a demand for a walking-type snow removal machine which can be used easily at any time even in such a small area as a residential area in the suburbs or an urban district.

Further, in the snow removal machine disclosed in the above-mentioned publication, the right and left crawlers always have the same running speed. Accordingly, when the running direction of the snow removal machine is changed or corrected, a difference in rotational speed between the right and left crawlers cannot be absorbed. It is thus required to hold up the snow removal machine with human power to suspend in midair one of the crawlers to change the direction. However, the snow removal machine runs with the crawlers having larger ground-contacting surfaces and has a larger turning radius, thereby presenting a problem of difficult turning.

SUMMARY OF THE INVENTION

It is therefore an object of the present invention to provide a walking-type snow removal machine that can be used easily at any time and turns easily with agility.

According to one aspect of the present invention, there is provided a snow removal machine comprising a body frame, a snow removing member provided at the front of the body frame for pushing out snow, operating handles provided at the rear of the body frame, crawler belts provided on the right and left sides of the body frame, an electric motor provided on the body frame for driving the right and left crawler belts through right and left drive wheels, and a battery provided on the body frame for supplying electric power to the electric motor.

The electric motor supplied with power by the battery drives the right and left crawler belts through the right and left drive wheels. The operator controls the operating handles while walking to propel the snow removing machine. The snow removing member provided at the front of the body frame pushes out snow forward to remove snow easily. Thus the snow removal machine can be used even in a small area. Since the electric motor is used as a drive source, the snow removal machine can be made small as compared with a snow removal machine employing an engine. In addition, it generates very small noise and can be used at any time from early morning till midnight.

In a preferred form, the snow removal machine further comprises a control device for controlling the electric motor. The right and left drive wheels are desirably disposed at the front part of the right and left crawler belts. The electric motor is desirably disposed in such a manner that the center of gravity of the electric motor is positioned in the vicinity of the center of axles of the right and left drive wheels. The battery is disposed in such a manner that the center of gravity of the battery is positioned behind the center of gravity of the electric motor. The control device is disposed in such a manner that the center of gravity of the control device is positioned behind the center of gravity of the battery. That is, the electric motor and the battery of relatively large weight are positioned in forward positions, whereby the center of gravity of the snow removal machine is positioned forward, so that the snow removing member easily plunges into snow. Further, since the center of gravity of the snow removal machine is biased to the side of the drive wheels, the driving force of the drive wheels on the crawler belts can be sufficiently obtained. More specifically, the center of the motor shaft of the electric motor may be disposed above and ahead of the center of the axles of the drive wheels. Further, it is preferred to dispose the control device in a position to prevent it from snow damage.

Desirably, an extension line of the body frame is arranged to pass substantially over the center: point of a height of the snow removing member on a snow removing surface of the snow removing member when the body frame is inclined with its front part held downward. In removing snow, snow force acting on the snow removing member in an upwardly slanting direction to the rear is supported on the shaft center of the body frame in the longitudinal direction. Thus, large eccentric load does not act on the body frame.

Preferably, the snow removal machine further comprises a differential gear interposed between the axles on which to couple the right and left drive wheels. Power of the electric motor is transmitted to the right and left drive wheels through the differential gear and the axles. Accordingly, when the running direction of the snow removal machine is changed or corrected, difference in rotational speed between the right and left drive wheels is absorbed by the differential gear. Thus, the snow removal machine can easily change its direction and has a smaller turning radius.

BRIEF DESCRIPTION OF THE DRAWINGS

A preferred embodiment of the present invention will be described in more detail below, by way of example only, with reference to the accompanying drawings, in which:

FIG. 8A is a sectional view of the expansion mechanism of FIG. 6 in the most-extended state, while

DETAILED DESCRIPTION OF THE PREFERRED EMBODIMENT

The following description is merely exemplary in nature and is in no way intended to limit the invention, its application or uses.

Figure 1:
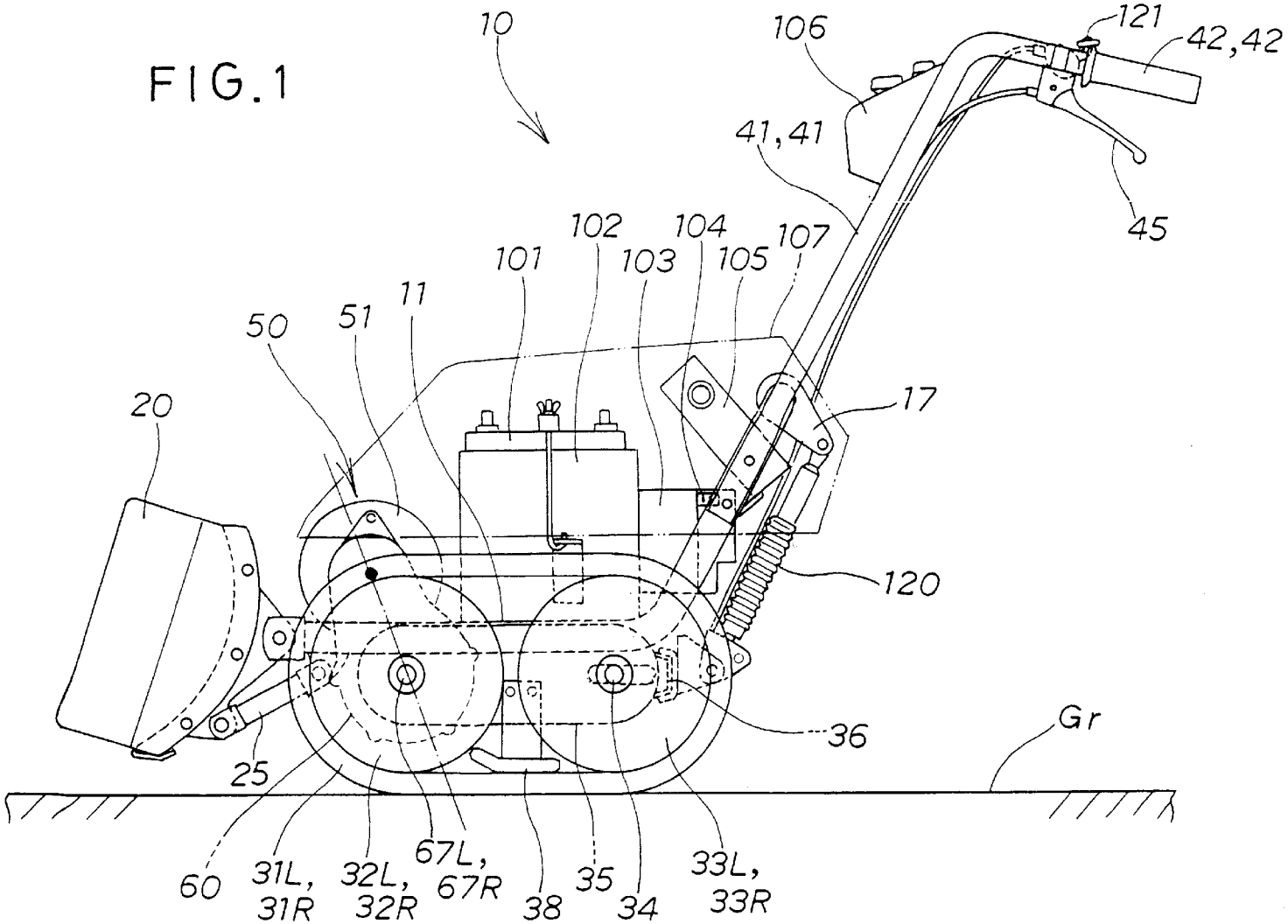
FIG. 1 is a side view showing a snow removal machine according to the present invention.
Figure 2:
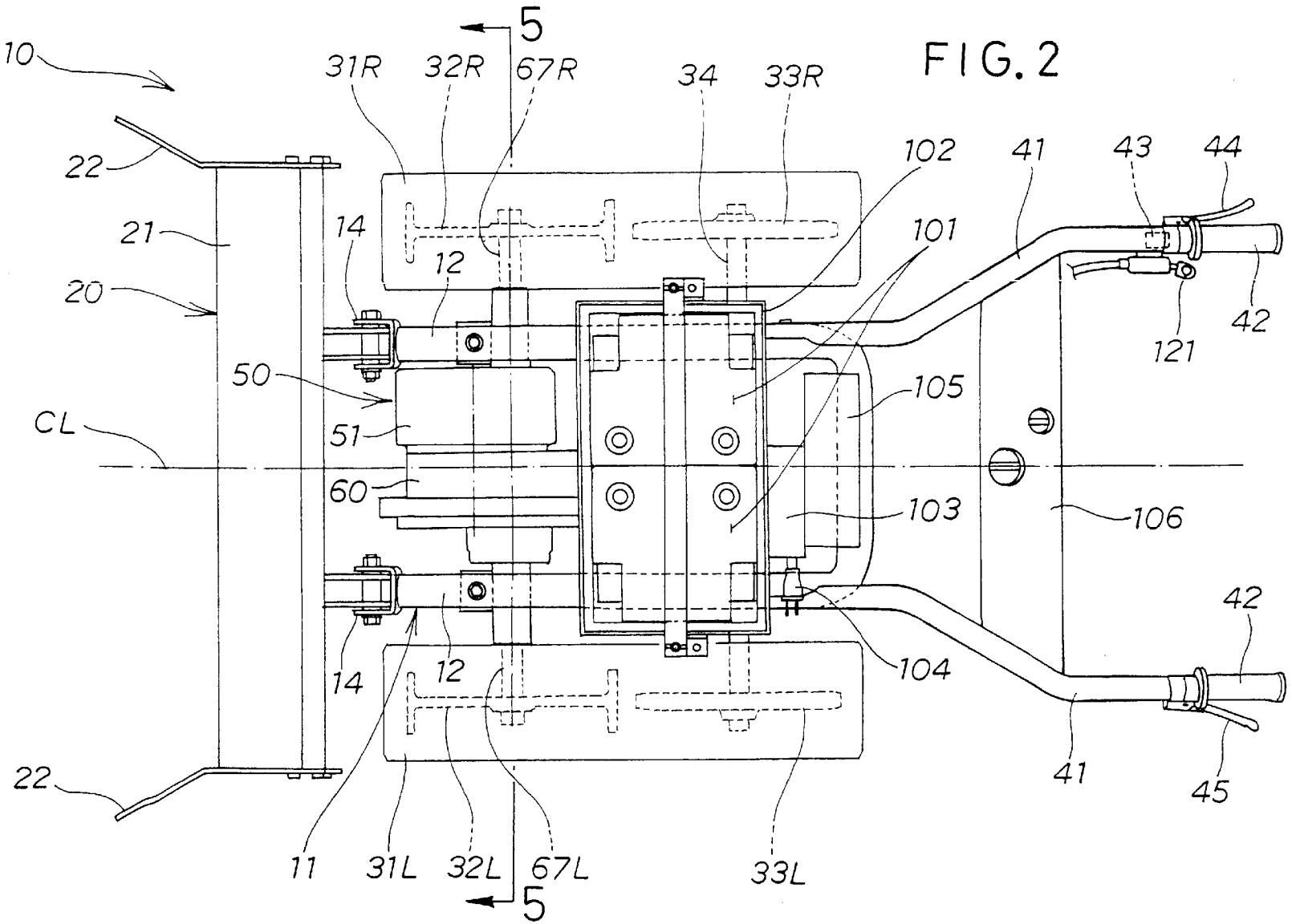
FIG. 2 is a top plan view of the snow removal machine shown in FIG. 1.

As shown in FIGS. 1 and 2, a snow removal machine 10 has a snow removing member 20 at the front of a body frame 11. Crawler belts 31R, 31L (See FIG. 2) are provided on the right and left sides of the body frame 11, respectively. Right and left operating handles 41, 41 are provided at the rear of the body frame 11. An electric motor 51, a power transmission mechanism 60, a pair of right and left batteries 101, 101, a charger 103 and a control device 105 are mounted to the body frame 11. The snow removal machine 10 is a walking-type snow removal machine that is self propelled with the electric motor 51 driving as a drive source the pair of right and left crawler belts 31R, 31L, while being controlled by the operator not shown in the figures walking with the operating handles 41, 41.

The pair of batteries 101, 101 are electric sources supplying electric power to the electric motor 51, which batteries are mounted to the upper part of the body frame 11 through a battery box 102.

The charger 103 charges the batteries 101, 101 with a plug 104 inserted into an AC power receptacle of a home power source or the like. The charger 103 is attached to the battery box 102.

The control device 105 controls the electric motor 51 based on signals from a Operating panel 106 provided on the operating handles 41, 41 and a potentiometer that is described later. The control device 105 is attached to the side of the charger 103. In FIG. 1, the reference numeral 38 designates a belt biasing member and 107 designates a cover.

Right and left drive wheels 321R, 32L are disposed on the front side of the right and left crawler belts 31R, 31L. Right and left rolling wheels 33R, 33L are disposed on the rear side of the right and left crawler belts 31R, 31L. The crawler belts 31R, 31L are wound around the drive wheel 32R and the rolling wheel 33R, and 32L and 33L, respectively.

The right and left operating handles 41, 41 extend backwardly from the rear of the body frame 11. The operating handles 41, 41 have grips 44, 44 at their ends. In the vicinity of the right grip 42, a operating lever 44 for changing the rotational number of the electric motor 51 and the potentiometer 43 are provided. The left grip 42 is provided with a brake lever 45 for braking the right and left drive wheels 32R, 32L.

The snow removal machine 10 pushes snow forward with the snow removing member 20 to easily clear the snow. Thus it is convenient to use even in a smaller area than an area where the conventional auger-type snow removal machine can work. Further, since the electric motor 51 is employed as a drive source for the crawler belts 31R, 31L, the drive mechanism can be made much smaller than in the case where an engine is employed, which results in the more compact snow removal machine 10 as a whole. The snow removal machine 10 of the present invention is thus a compact waking-type snow removal machine, which provides agility and enhanced transportability and operability, reducing labor of the operator.

Employing the electric motor 51 as a drive source enables much smaller noise than an engine. Accordingly it is possible to use the snow removal machine 10 to remove snow easily at any time during long hours from early morning till night.

Figure 3:
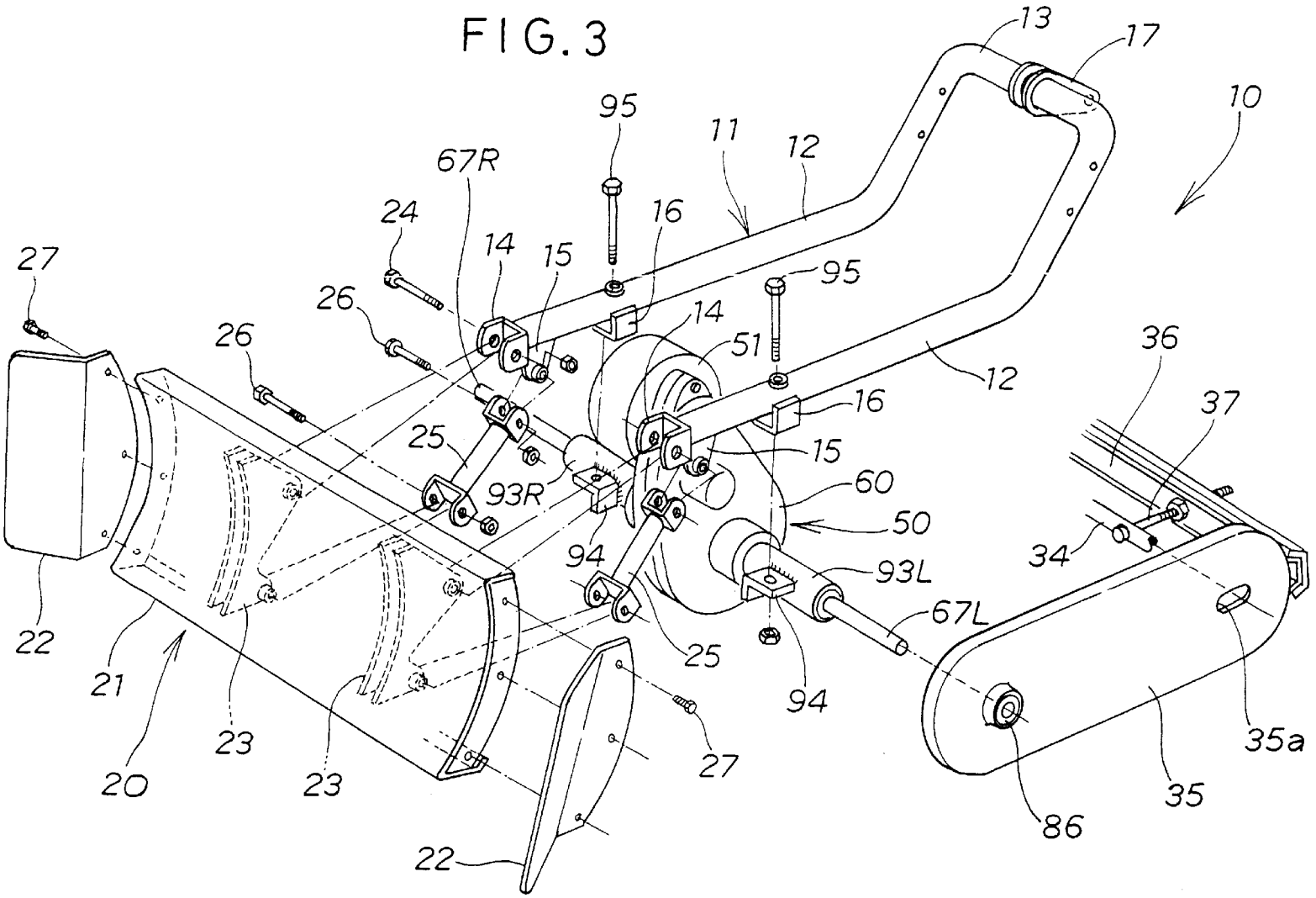
FIG. 3 is an exploded perspective view of the snow removal machine shown in FIG. 1.

As shown in FIG. 3, the body frame 11 is a pipe frame of a U-shaped pipe material having right and left horizontally extending side members 12, 12 with their rear parts inclined upwardly in the rearward direction, and a cross member 13 extending between the rear ends of the side members 12, 12. The right and left side members 12, 12 are provided with fork ends 14, 14 at the top ends thereof, right and left brackets 15, 15 at the front bottoms thereof, and right and left brackets 16, 16 at some midpoints of the lengths. The cross member 13 is provided with a bracket 17 in the middle of the width.

The snow removing member 20 is equipped with a snow removing part 21 detachably mounted to the front of the body frame 11 to push out snow, and guide plates 22, 22 in a plate shape mounted to the right and left of the snow removing part 21 to guide snow into the snow removing part 21. The snow removing part 21 has an arcuate cross section curved projectingly in the rearward direction of the vehicle body in a side view. On the rear surface of the snow removing part 21, right and left mounting panels 23, 23 are provided, which also serve as vertical ribs. The mounting plates 23, 23 are attached at their upper parts to the fork ends 14, 14 with bolts and nuts 24, 24, and are attached at their lower parts to the brackets 15, 15 through right and left mounting arms 25, 25 with bolts and nuts 26, 26. The snow removing member 20 is thus detachably mounted to the front of the body frame. The reference numerals 27, 27 designate bolts for attaching the guide plates 22, 22 to the snow removing part 21.

A drive mechanism 50 has a structure into which the electric motor 51 and the power transmission mechanism 60 are integrally incorporated. The drive mechanism 50 has hangers 94, 94 on the right and left sides, and are detachably mounted at some midpoints of lengths of the body frame 11 with the top surfaces of the hangers 94, 94 laid over the bottom surfaces of the brackets 16, 16 and connected to them by bolts and nuts 95, 95.

Figure 4:
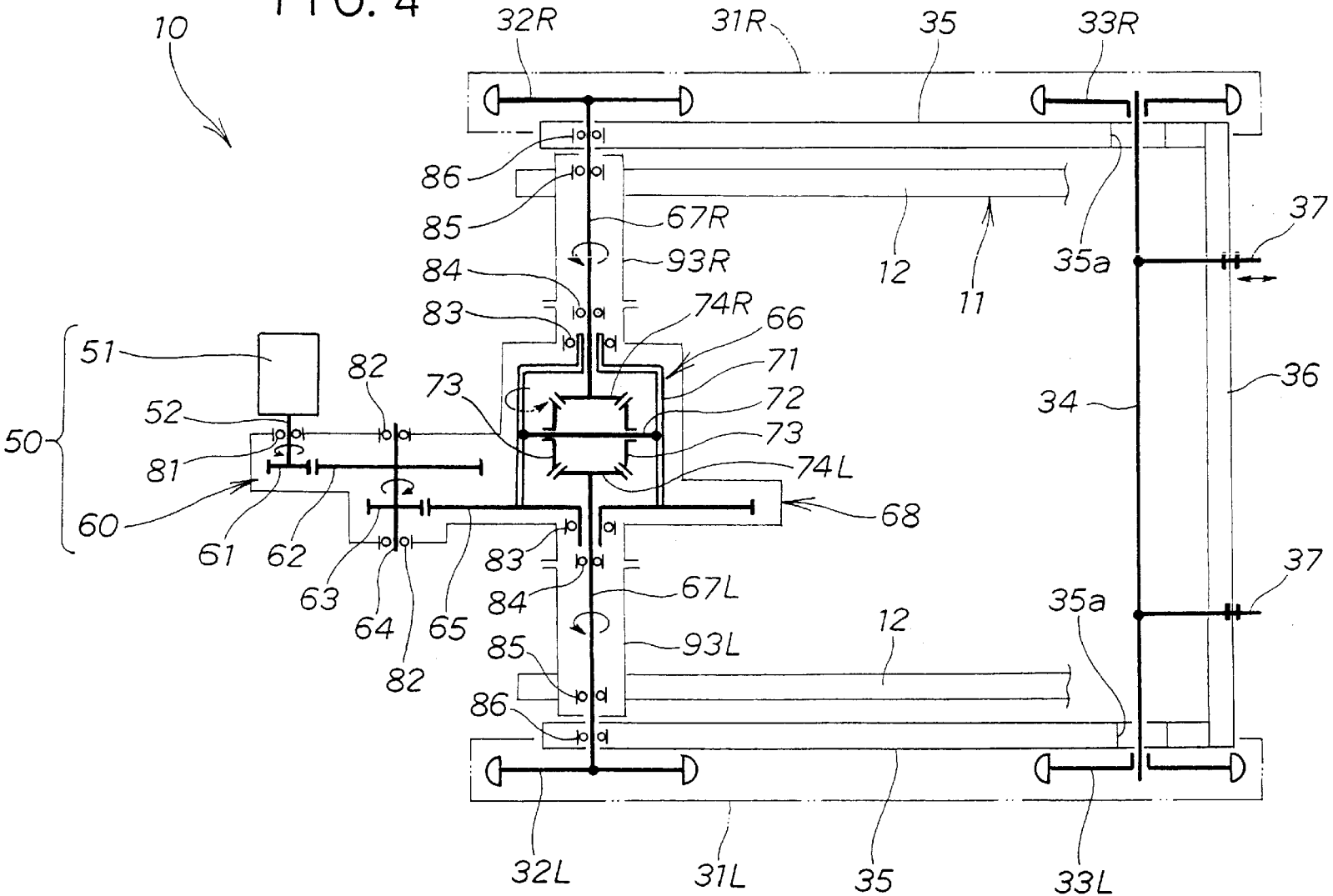
FIG. 4 is a schematic top plan view of crawler belts, a drive mechanism and its surroundings of the snow removal machine shown in FIG. 1.

FIG. 4 shows a schematic diagram of the crawler belts, the drive mechanism and the surroundings of the snow removal machine of the present invention.

In FIG. 4, the power transmission mechanism 60 consists of a first small gear 61 coupled to a motor shaft 52 of the electric motor 51, a first large gear 62, a second small gear 63, a second large gear 65, a differential gear 66 and right and left drive wheel axles 67R, 67L. These members are housed in a case 68. The first large gear 62 engages with the first small gear 61, having a larger diameter than the first small gear 61. The second small gear 63 has a smaller diameter than the first large gear 62. The first large gear 62 and the second small gear 63 are coupled to rotate in the same direction through an intermediate shaft 64. The second large gear 65 engages with the second small gear 63, having a larger diameter than the second small gear 63. The differential gear 66 is coupled to the second large gear 65. The right and left drive wheel axles 67R, 67L are coupled to the differential gear 66. Each of the gears 61 to 63 and 65 is a spur gear. To the right and left drive wheel axles 67R, 67L, the right and left drive wheels 32R, 32L are mounted.

The differential gear 66 consists of a differential case 71 concentrically mounted to a side surface of the second large gear 65, a pivot shaft 72 mounted to the differential case 71, a pair of drive bevel gears 73, 73 mounted for idle rotation on the pivot shaft 72, a pair of right and left driven bevel gears 74R, 74L engaging with the drive bevel gears 73, 73, and the right and left drive wheel axles 67R, 67L coupled to the driven bevel gears 74R, 74L. The pivot shaft 72 extends in a direction perpendicular to the drive wheel axles 67R, 67L.

With the differential gear 66 interposed between the right and left drive wheel axles 67R, 67L, power from the electric motor 51 is transmitted through the differential gear 66 and the drive wheel axles 67R, 67L to the right and left drive wheels 32R, 32L to drive the right and left crawler belts 31R, 31L. The direction of rotation of the right and left drive wheels 32R, 32L corresponds to that of the motor shaft 52.

The right and left rolling wheels 33R, 33L are rotatably mounted to a rolling wheel axle 34.

The snow removal machine 10 further includes a pair of right and left driving frames 35, 35 (See FIG. 3) narrowly extending back and forth, which are disposed inside the right drive wheel 32R and the right. rolling wheel 33R, and the left drive wheel 32L and the left rolling wheel 33L, respectively. Across the rear ends of the driving frames 35, 35, a cross member 36 is extended. The right and left driving frames 35, 35 support at their front parts the right and left drive wheel axles 67R, 67L, permitting their rotation, and supports at their rear parts the rolling wheel axle 34, permitting its rotation. Right and left adjusting bolts 37, 37 extending from the rolling wheel axle 34 in the rearward direction are fitted to the cross member 36 so that they are adjustable in the back and forth directions. With the adjusting bolts 37, 37 adjusted in the back and forth directions, the rolling wheel axle 34 is moved back and forth to adjust the tension of the right and left crawler belts 31R, 31L.

In the figure, the reference numeral 35*a* designates a long hole extending back and forth, and the reference numerals 81 to 86 designate bearings.

Figure 5:
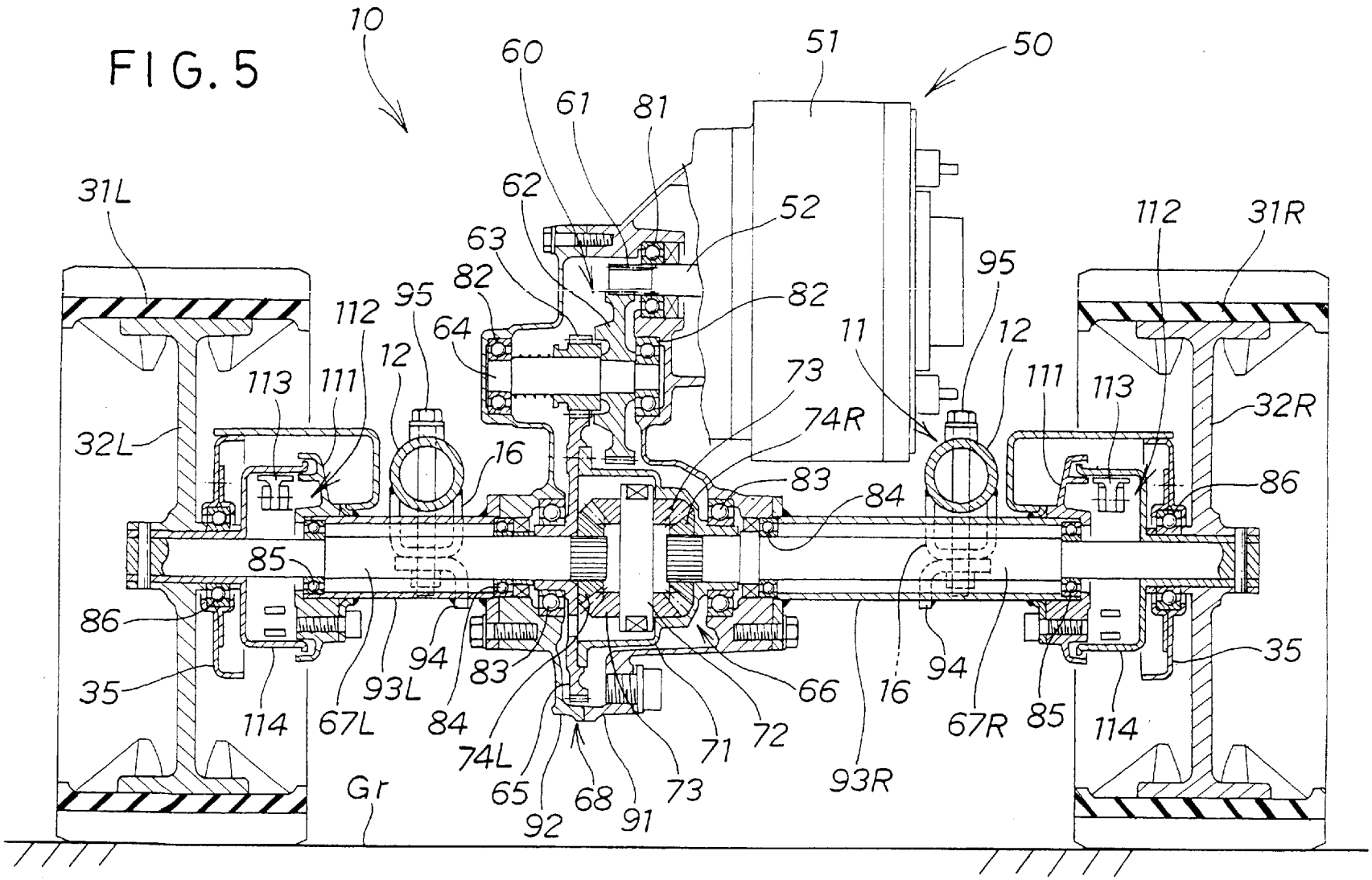
FIG. 5 is an enlarged sectional view of the snow removal machine taken along line 5—5 of FIG. 2.

FIG. 5 shows an enlarged specific sectional view taken along the line 5—5 in FIG. 2.

The case 68 of the power transmission mechanism 60 has a case body 91, a lid 92 bolted to the case body 91 to block the opening of the case body 91, a tubular right axle case 93R bolted to the right end of the case body 91 and a tubular left axle case 93L bolted to the left end of the lid 92.

The electric motor 51 is bolted to the case body 91. The intermediate shaft 64 is rotatably supported by the case body 91 and the lid 92 through the bearings 82, 82. The right axle case 93R and the left axle case 93L are concentrically disposed and house the right and left drive wheel axles 67R, 67L. The right and left drive wheel axles 67R, 67L are rotatably supported by the right and left axle cases 93R, 93L through the bearings 84, 84 and 85, 85.

Right and left brake covers 111, 111 are bolted to the top ends of the right and left axle cases 93R, 93L. Right and left brake mechanisms 112, 112 are mounted to the right and left brake covers 111, 111. Each of the brake mechanisms 112 is a radially expanding drum brake. Each brake mechanism mainly consists of a brake shoe 113 with a brake pad mounted to the brake cover 111, a cam not shown in the figure for expanding the brake shoe 113 in diameter and a brake drum 114 surrounding the brake shoe 113. The brake drums 114, 114 are mounted to the right and left drive wheel axles 67R, 67L. Through the operation of the brake lever 45 as shown in FIG. 2, the brake drums 114, 114 on the rotating side are braked with the brake shoes 113, 113 on the stationary side through brake;cables and cams not shown in the figure, thereby to stop the snow removal machine 10.

The drive mechanism 50 is mounted to the body frame 11 by fastening the side members 12, 12, the brackets 16, 16 of the side members 12, 12 and the hangers 94, 94 of the right and left axle cases 93R, 93L to each other with bolts and nuts 95, 95. The case 68 is rotatable on the drive wheel axles 67R, 67L through the bearings 83, 83. Accordingly the body frame 11 can swing up and down on the drive wheel axles 67R, 67L.

Figure 6:
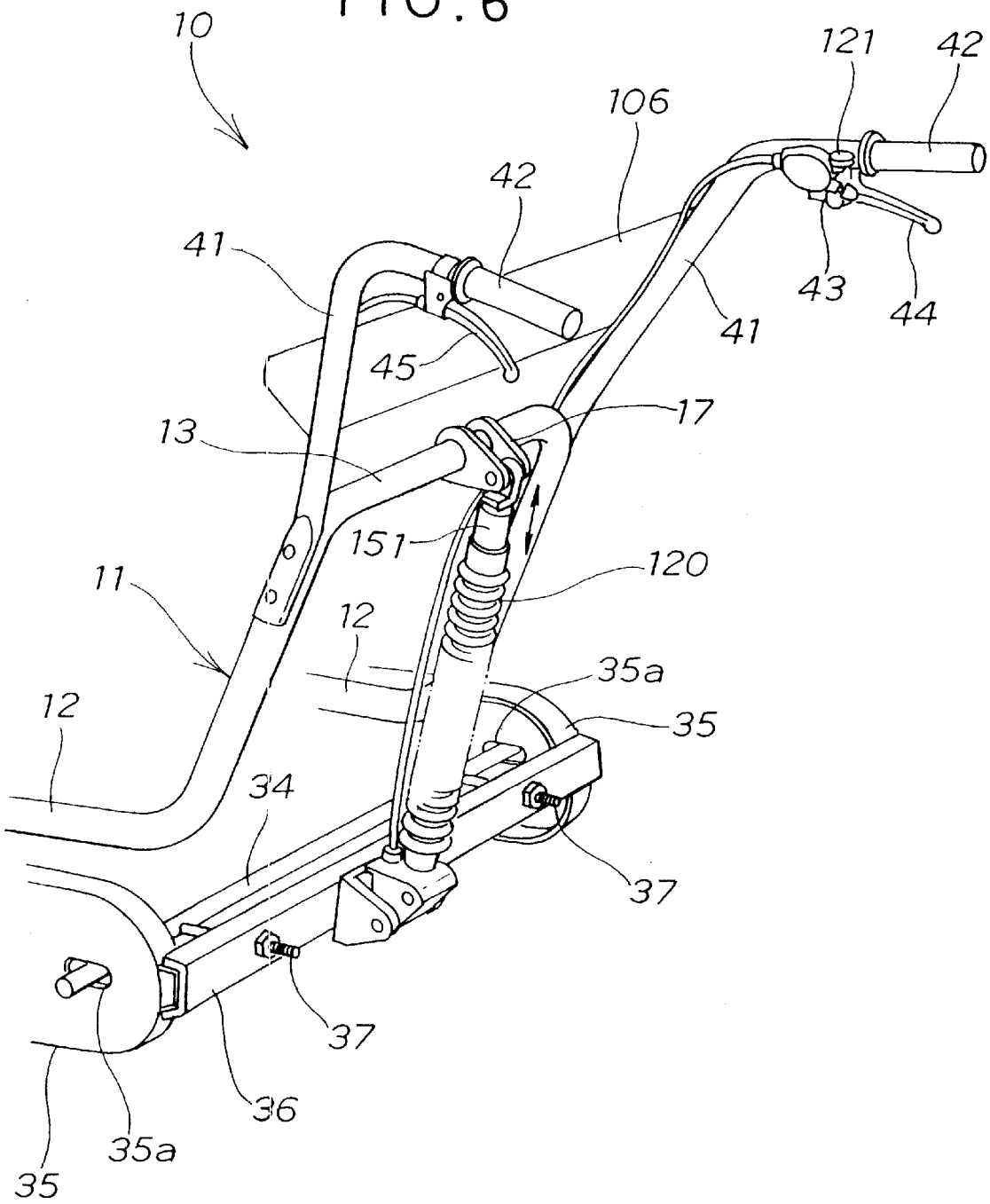
FIG. 6 is an. enlarged perspective view showing details of an expansion mechanism provided at the rear of the snow removal machine of FIG. 1.

As shown in FIG. 6, the snow removal machine 10 is equipped with an expansion mechanism 120 for permitting the up and down swings of the body frame 11 to adjust the height of the snow removing member 20 as shown in FIG. 1, as well as stopping the up and down swings of the body frame 11 after the adjustment of the height of the snow removing member 20. The expansion mechanism 120 has a structure in which a hanger 121 on its top end is attached to the bracket 17 with a pivot pin 122 in such a manner that it can swing back and front, and its bottom end is attached to the cross member 36 through a connector bar 123. The mounting structure of the bottom end of the expansion mechanism 120 will be described later. The connector bar 123 is a long length of member fastened to the cross member 36 with the right and left adjusting bolts 37, 37 along the back surface of the cross member 36 between the right and left driving frames 35, 35. In the vicinity of the right grip 42, a height adjusting lever mechanism 140 that is described later is mounted.

Figure 7:
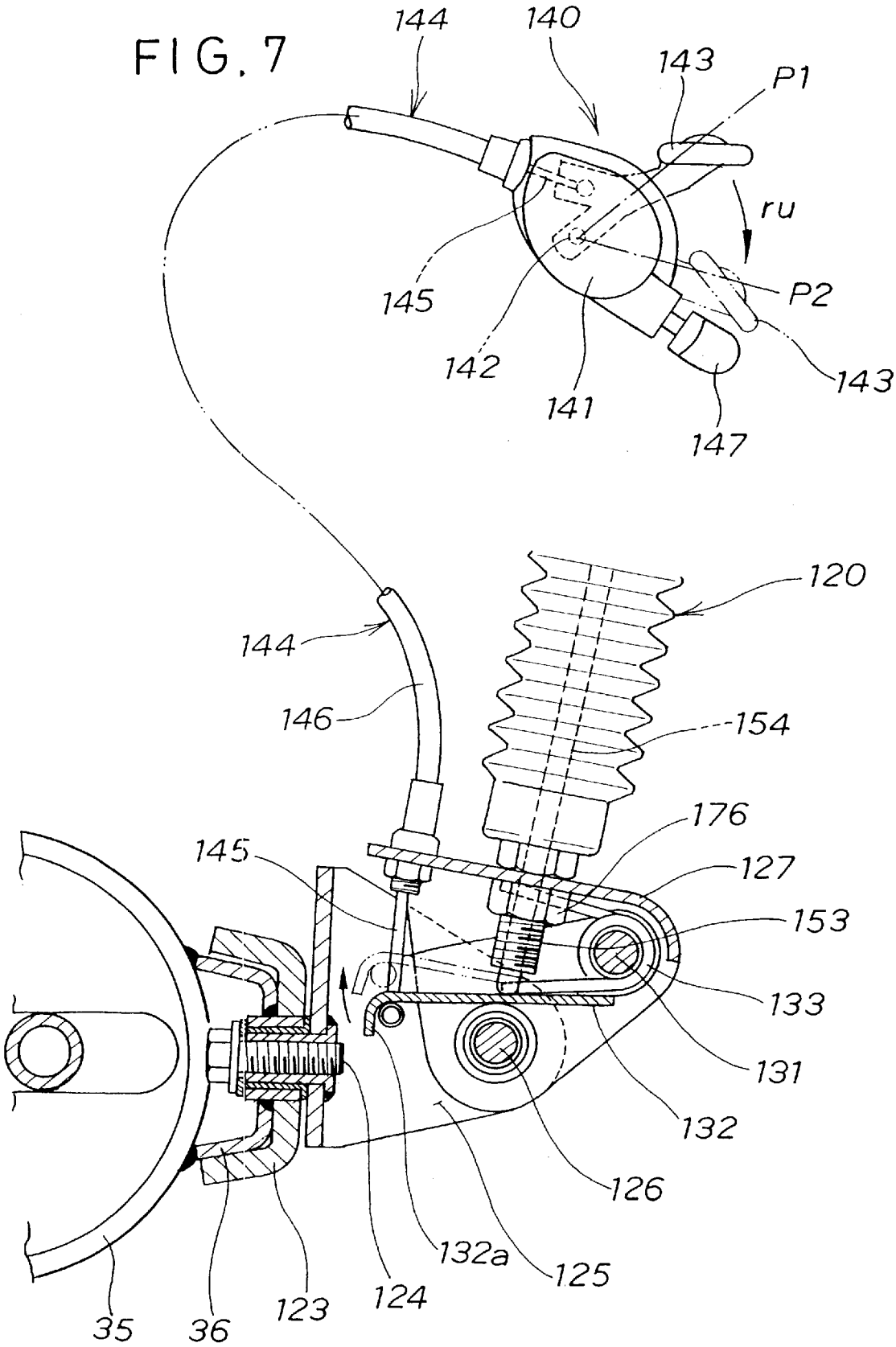
FIG. 7 is a partial sectional view of a mounting structure of the lower part of the expansion mechanism and an adjusting lever mechanism.

FIG. 7 shows details of the mounting structure of the lower part of the expansion mechanism 120 and the adjusting lever mechanism 140 as shown in FIG. 6.

The mounting structure of the lower part of the expansion mechanism 120 includes a pivot bolt 124 in the middle of the body width of the connector bar 123. A first bracket 125 is rotatably attached to the pivot bolt 124. A second bracket 127 is attached to the first bracket 125 so as to be able to rotate up and down through a first pivot pin 126. A piston rod 153 of the expansion mechanism 120 is screwed at its lower part in the second bracket 127 for attachment, thereby to attach the lower part of the expansion mechanism 120 to the cross member 36 in such a manner that it can swing up and down and rotate from side to side.

The second bracket 127 has a second pivot pin 131. A swing arm 132 is rotatably mounted at its base end to the second pivot pin 131. The swing arm 132 is a moving member extending in such a manner that a push rod 154 protruded downwardly from the piston rod 153 abuts at its bottom end against the swing arm 132. The swing arm 132 is resiliently biased downwardly with a torsion spring 133 wound on the second pivot pin 131. The first pivot pin 126 serves as a stopper when the swing arm 132 swings downwardly.

The height adjusting lever mechanism 140 has an operating lever 143 installed into a case 141 through a shaft 142. When the operating lever 143 is pushed by the operator' s thumb to rotate in a clockwise direction as shown by an arrow "ru," an inner wire 145 of a wire cable 144 is pulled. When a releasing lever 147 is pushed to the right, an auto-return mechanism not shown in the figure makes the operating lever 143 automatically come back to the position shown in a solid line from the position shown in a phantom line in the figure. The height adjusting lever mechanism 140 has a structure similar to that of a so-called speed changing lever mechanism mounted to a handle of a bicycle for shifting a speed changing clutch to high speed/low speed.

The wire cable 144 has a structure in which one end of the inner wire 145 pulled by the operating lever 143 is hooked on a swing tip 132*a* of the swing arm 132, and one end of an outer tube 146 covering the inner wire 145 is attached to the second bracket 127.

Figure 8A:
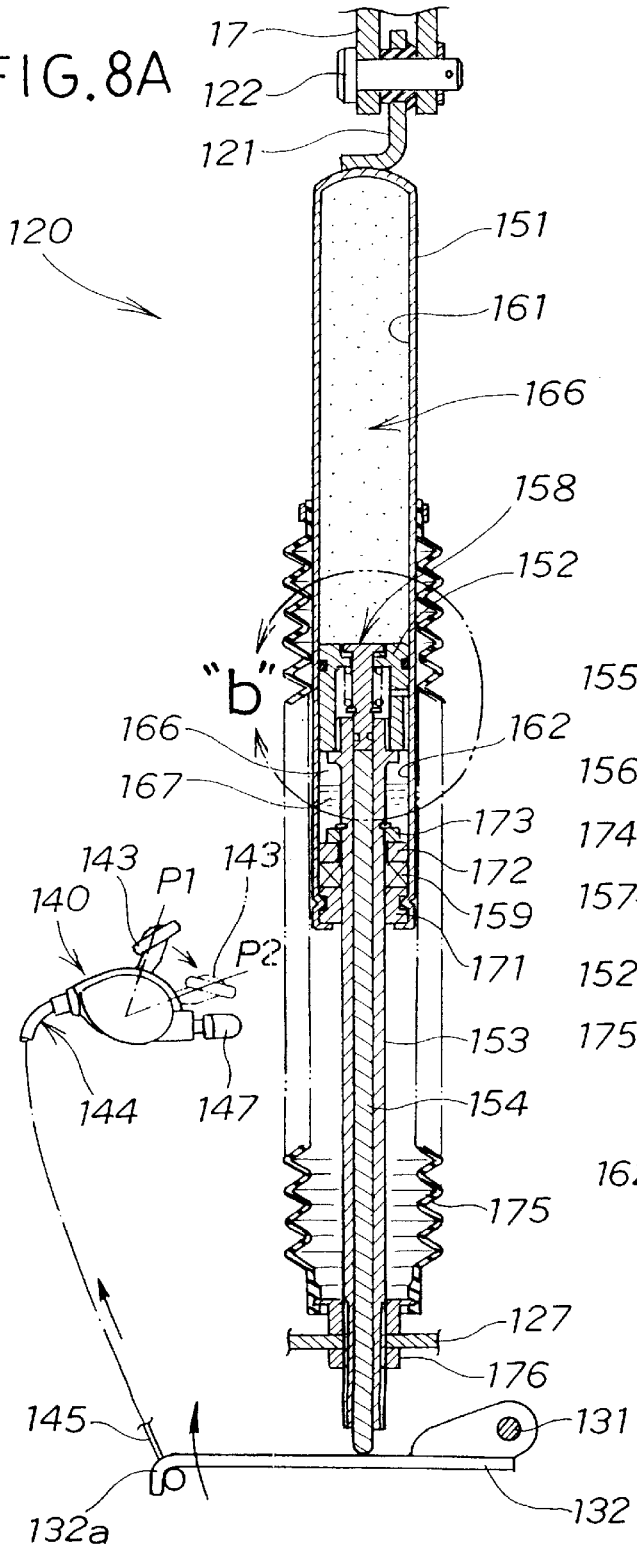
Figure 8B:
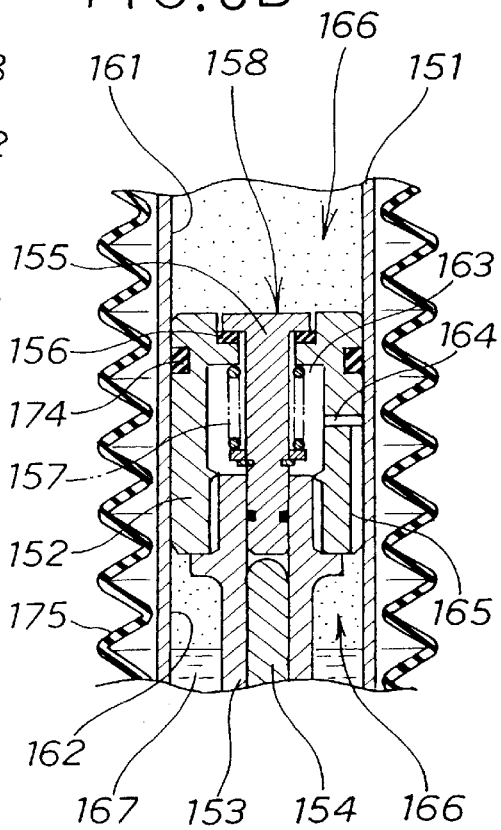
FIG. 8B is an enlarged sectional view of a part denoted by reference character "b" of FIG. 8A.

FIGS. 8A and 8B show sectional views showing the structure of the expansion mechanism 120 as shown in FIG. 6. FIG. 8A shows a sectional view of the expansion mechanism 120 in the most extended state. FIG. 8B shows an enlarged sectional view of a part indicated by "b" in FIG. 8A.

The expansion mechanism 120 has a cylinder 151 with the closed upper end, a tubular piston 152 reciprocatingly movable in the cylinder 151, a tubular piston:rod 153 attached to the bottom end of the piston 152 and extending downwardly, a push rod 154 reciprocatingly movable in the piston rod 153, a valve element 155 driven by the push rod 154 to move up and down in the piston 152, a valve seat 156 provided at the upper end of the piston 152 for opening/closing thereof by motions of the valve element 155, and a compression spring 157 resiliently biasing the valve element 155 in a direction to block the valve seat 156 by the valve element 155.

The combination of the valve element 155, the valve seat 156 and the compression coil 157 constitutes a valve 158. The inner space of the cylinder 151 is partitioned off into an upper chamber 161 and a lower chamber 162 by the piston 152 with the lower end of the cylinder 151 closed by an oil seal 159. The upper chamber 161 and the lower chamber 162 communicate with each other through the valve 158, the space 163 inside the piston 152 and channels 164, 165 formed in the piston 152. The upper chamber 161 and the lower chamber 162 are filled with a high pressure gas 166 such as a high pressure air. The lower chamber 162 is further filled with an oil 167.

In the figures, the reference numeral 171 designates a sliding bearing, 172 designates a cylinder-side stopper, 173 designates a piston rod-side stopper, 174 designates an 0 ring, 175 designates a boot and 176 designates a nut.

As shown in FIG. 8A, when the operating lever 143 is in a blocking position P1 as shown in a solid line, the valve 158 is closed as show:n in FIG. 8B. In this state, a high pressure gas 166 cannot pass between the upper chamber 161 and the lower chamber 162.

When the operating lever 143 is shifted to a releasing position P2 as shown in a phantom line so as to pull the inner wire 145, the swing arm 132 swings upwardly to push up the push rod 154. The push rod 154 pushes up the valve element 155, thereby to open the valve 158. The upper chamber 161 and the lower chamber 162 communicate with each other through the valve 158, the space 163 and the channels 164, 165. As a result, the high pressure gas 166 can pass between the upper chamber 161 and the lower chamber 162.

When the releasing lever 147 is pushed, the operating lever 143 automatically returns from the releasing position P2 to the original blocking position P1. As a result, the swing arm 132 swings downwardly to automatically return to the original position as shown in the figure. The push rod 154 then goes down and the valve 158 is again closed. The high pressure gas 166 cannot pass between the upper chamber 16i and the lower chamber 162.

Figure 9:
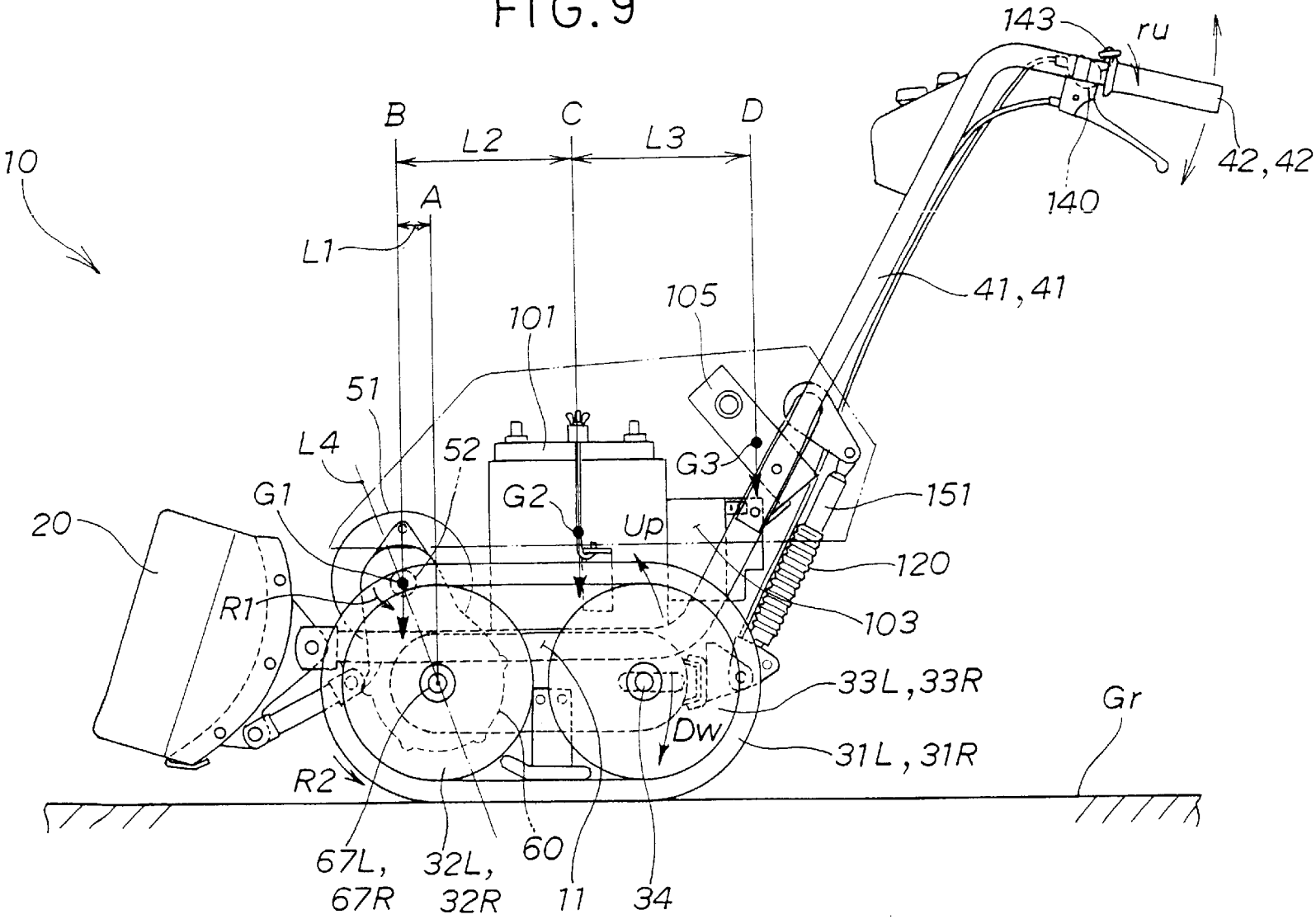
FIG. 9 is a schematic side elevational view showing the positional relationship between the components of the snow removal machine according to the present invention.

FIG. 9 shows an explanatory view of the arrangement relationship of components of the snow removal machine according to the present invention.

In the side view of the snow removal machine 10, the central position of the right and left drive wheel axles 67R, 67L is denoted by "A," the position of the center of gravity G1 of the electric motor 51 is "B," the position of the center of gravity G2 of the battery 101 is "C," and the position of the center of gravity G3 of the control device 105 is "D." The center of the motor shaft 52 is positioned at B.

The center of gravity G1 is positioned at the position B spaced apart by distance L1 from the position A in the forward direction. The center of gravity G2 is positioned at the position C spaced apart by distance L2 from the position B in the backward direction. The center of gravity G3 is positioned at position D spaced apart by distance L3 from the position C in the backward direction. In addition, the center of gravity G1 is positioned at a higher level than the right and left drive wheel axles 67R, 67L. The center of gravity G2 is positioned at a higher level than the center of gravity G1. The center of gravity G3 is positioned at a higher level than the center of gravity G2. That is, the electric motor 51 is disposed in such a manner that the motor shaft 52 of the electric motor 51 is positioned forwardly above the center of the right and left drive wheel axles 67R, 67L. The battery 101 is disposed behind the electric motor 51. The charger 103 is disposed behind the battery 101. The control device 105 is disposed backwardly above the charger 103 (backwardly above the battery 101).

As described above, (1) the electric motor 51 is disposed in such a manner that the center of gravity G1 of the electric motor 51 of a relatively large weight is positioned in the vicinity of the center of the right and left drive wheel axles 67R, 67L, so as to set the distance L1 smaller; and (2) the position C is set in such a manner that the battery 101 is disposed with the center of gravity G2 of the battery 101 positioned behind the center of gravity G1 of the electric motor 51, and the center of gravity G2 of the battery 101 is positioned between the center of the rolling wheel axle 34 and the center of the drive wheel axles 67R, 67L.

With the arrangement (1) and (2), the center of gravity of the snow removal machine 10 is positioned forwardly. As a result, the snow removing member 20 can easily plunge into snow, reducing the operator's workload of removing snow.

Further, since the center of gravity of the snow removal machine 10 is biased to the side of the drive wheels 32R, 32L, the driving force of the drive wheels 32R, 32L on the crawler belts 31R, 31L can be fully obtained. Accordingly, the running-through performance of the snow removal machine 10 on snow with the crawler belts 31R, 31L is enhanced.

In addition, in the present embodiment, (3) the electric motor 51 is positioned in such a manner that the center of the motor shaft 52 is above and ahead of the center of the right and left drive wheel axles 67R, 67L (on an inclined straight line L4). The rotational direction R2 of the drive wheels 32R, 32L corresponds to the rotational direction R1 of the motor shaft 52, so that the torque acting direction of the drive wheels 32R, 32L can be made corresponding to that of the electric motor 51. When the snow removal machine 10 is propelled, the torque of the electric motor 52 generated in a position above and ahead of the drive wheel axles 67R, 67L is effectively utilized, thereby to obtain more sufficient driving force of the drive wheels 32R, 32L on the crawler belts 31R, 31L. Accordingly, the running-through performance of the snow removal machine 10 on snow with the crawler belts 31R, 31L is more enhanced. Further, the snow removing member 20 can more easily plunge into snow, reducing the operator's workload of removing snow.

Furthermore, in the present embodiment, (4) the control device 105 is disposed in such a manner that the center of gravity G3 of the control device 105 is positioned behind the center of gravity G2 of the battery 101. Thus the control device 105 is protected from snow damage.

Figure 10:
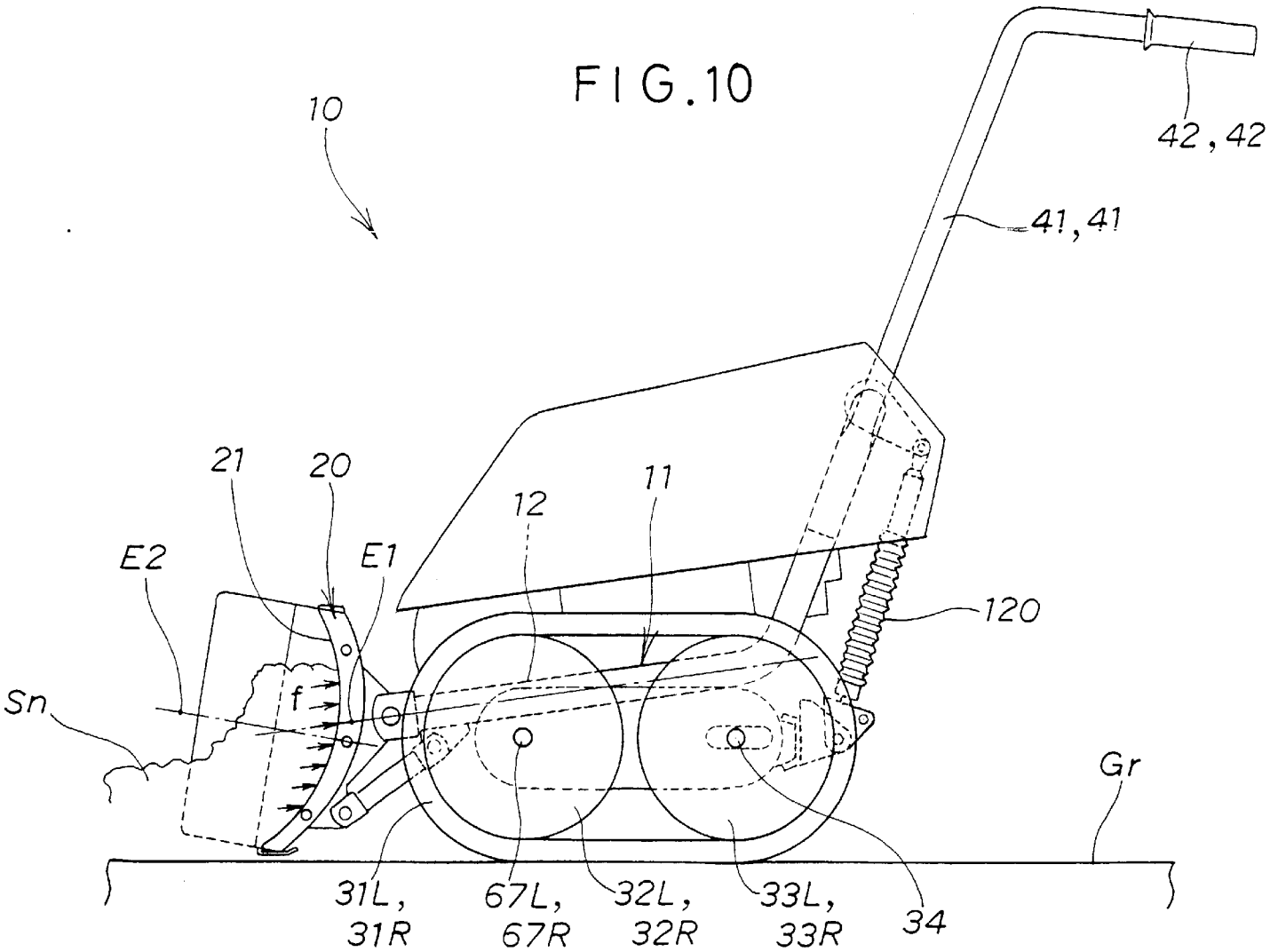
FIG. 10 is a schematic side elevational view showing an operation of the snow removal machine in a normal state in which its body frame is inclined halfway for snow removal.

Now, with reference to FIGS. 9 to 11, the snow removing function with the snow removal machine 10 as described above will be described.

FIG. 9 shows a state where the snow removing member 20 is held up at the highest position. In this state, the expansion mechanism 12 is contracted the most.

Only when the operating lever 143 of the height adjusting lever mechanism 140 is pushed in the direction of the arrow ru, the high pressure gas inside the cylinder 151 of the expansion mechanism 120 can pass through the piston to the upper or lower side. In this state, when the grips 42, 42 are held up, the expansion mechanism 120 is expanded, so. that the body frame 11 swings upwardly (in the direction of an arrow "Up") around the drive wheel axles 67R, 67L. As a result, the snow removing member 20 swings downwardly as shown in FIG. 10.

Thereafter, when the grips 42, 42 are held down, the expansion mechanism 120 is contracted, so that the body frame 11 swings downwardly (in the direction of an arrow "Dw") around the drive wheel axles 67R, 67L. As a result, the snow removing member 20 swings upwardly. In this manner, the snow removing member 20 can be adjusted in height.

When the operating lever 143 is returned to the original position, the high pressure gas inside the cylinder 151 of the expansion mechanism 120 cannot pass through the piston to the upper or lower side. In this state, the snow removing member 20 can be held at a certain height by blocking the upward and downward swings of the body frame 11.

Figure 11:
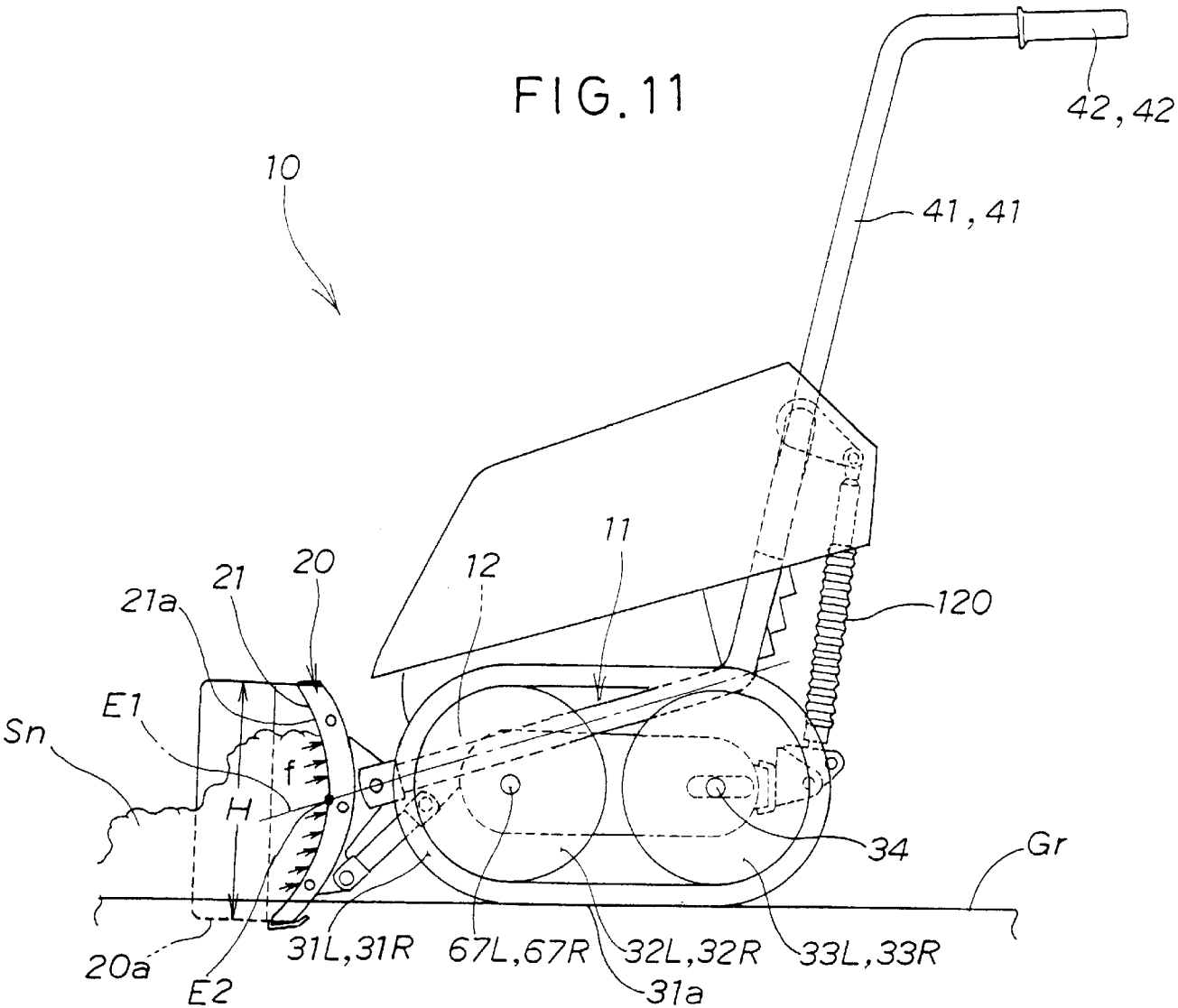
FIG. 11 is a view similar to FIG. 10 but showing a sectional view of the snow removal machine in a state in which the expansion mechanism is extended the most.

FIG. 11 shows the state where the snow removing member 20 is held down at the lowest position. In this state, the expansion mechanism 120 is expanded to the full extent.

As shown in FIG. 11, the snow removal machine 10 is set in such a manner that an extension line E1 of the body frame 11 passes through the center point E2 of height H of the snow removing member 20 on a snow removing surface 21*a* of the snow removing part 21 constituting the snow removing member 20 when the grips 42, 42 are held up and the body frame is inclined with the front down. At this time, the snow removing member 20 is upright and the bottom surface 20*a* of the snow removing member 20 is positioned below a ground-contacting surface 31*a* of the crawler belts 31R, 31L.

When snow is removed with the snow removal machine 10, the force f of the snow acting on the snow removing surface 21*a* of the snow removing part 21 of the snow removing member 20 usually acts in a upwardly slanting direction to the rear with respect to the snow removing part 21. The force f acting on the snow removing part 21 is supported on the shaft center in the longitudinal direction of the body frame inclined in substantially the same direction as that of the force f. Thus the slanting direction of the force f and the body frame 11 is substantially the same, so that no large eccentric load acts on the body frame 11 eliminating the need to enhance the strength of the body frame 11 more than required, reducing the weight of the body frame 11.

Further, when the body frame 11 is inclined with the front down, the center of gravity of the snow removal machine 10 moves to a forward position. Accordingly, the snow removing member 20 can easily plunge into snow Sn, reducing the operator's snow removing labor. Furthermore, the driving force of the drive wheels 32R, 32L on the crawler belts 31R, .31L is further enhanced. Accordingly, the running-through performance of the snow removal machine 10 on a road Gr or snow with the crawler belts 31R, 31L is further enhanced.

Now, with reference to FIGS. 12A to 13B the relationship between the running direction of the snow removal machine 10 and the function of the power transmission mechanism 60 will be described.

Figure 12B:
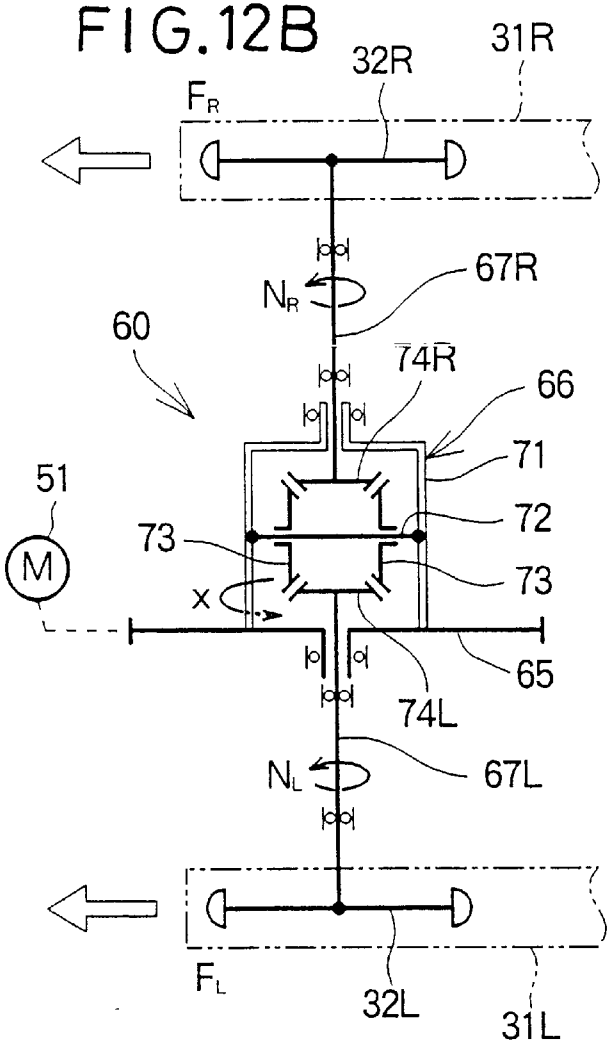
FIG. 12B is a schematic diagram showing a power transmission mechanism of the snow removal machine in such motion.
Figure 12A:
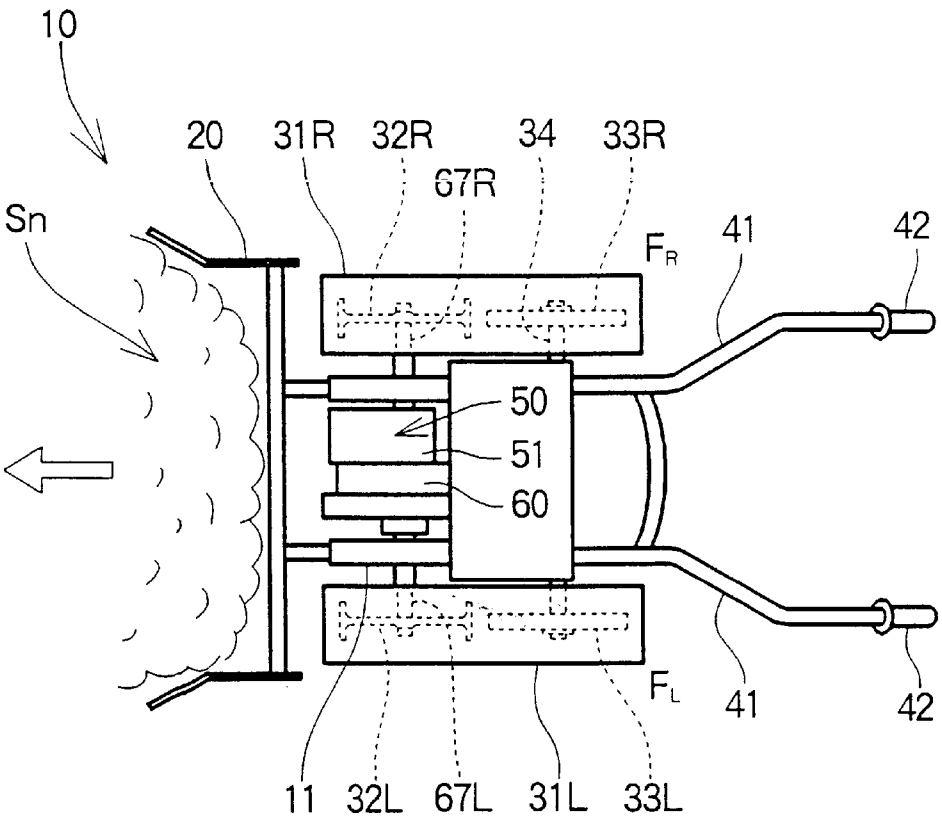
FIG. 12A is a top plan view showing an operation of the snow removal machine in linear forward motion.

FIG. 12A shows that the operator walking not shown in the figure holds the grips 42, 42 and operates the snow removal machine 10 to run linearly forward, removing snow with the snow removing member 20 pushing out the snow Sn in front. Here, the frictional resistance FR between a road surface and the right crawler belt 31R is equal to the frictional resistance FL between a road surface and the left crawler belt 31L in the case of running linearly on a flat road.

FIG. 12B shows the power transmission mechanism 60 and the surroundings in the state where the snow removal machine 10 runs linearly as shown in FIG. 12A.

Power of the electric motor 51 makes the second large gear 65, the differential case 71 and the pivot shaft 72 rotate in the direction of an arrow "x," and makes the drive bevel gears 73, 73 revolve in the direction of the arrow x, and makes the right and left driven bevel gears 74R, 74L, the right and left drive wheel axles 67R, 67L and the right and left drive wheels 32R and 32L rotate in the direction of the arrow x. As a result, the right and left crawler belts 31R, 31L is propelled.

Since FR=FL, the driving force of the right driven bevel gear 74R and the driving force of the left driven bevel gear 74L are the same. Accordingly, the drive bevel gears 73, 73 do not rotate on the pivot shaft 72. The rotational speed NR of the right drive wheel 32R is equal to the rotational speed NL of the left drive wheel 32L. Accordingly, the right and left crawler belts 31R, 31L have the same running speed.

Figure 13B:
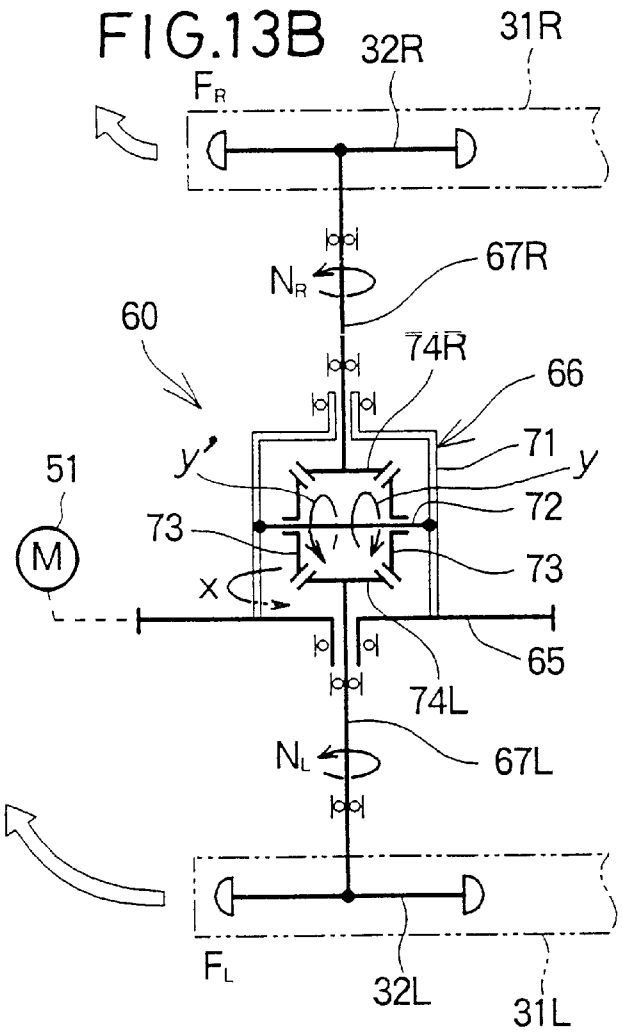
FIG. 13B is a schematic diagram showing the power transmission mechanism of the snow removal machine making such a turn.
Figure 13A:
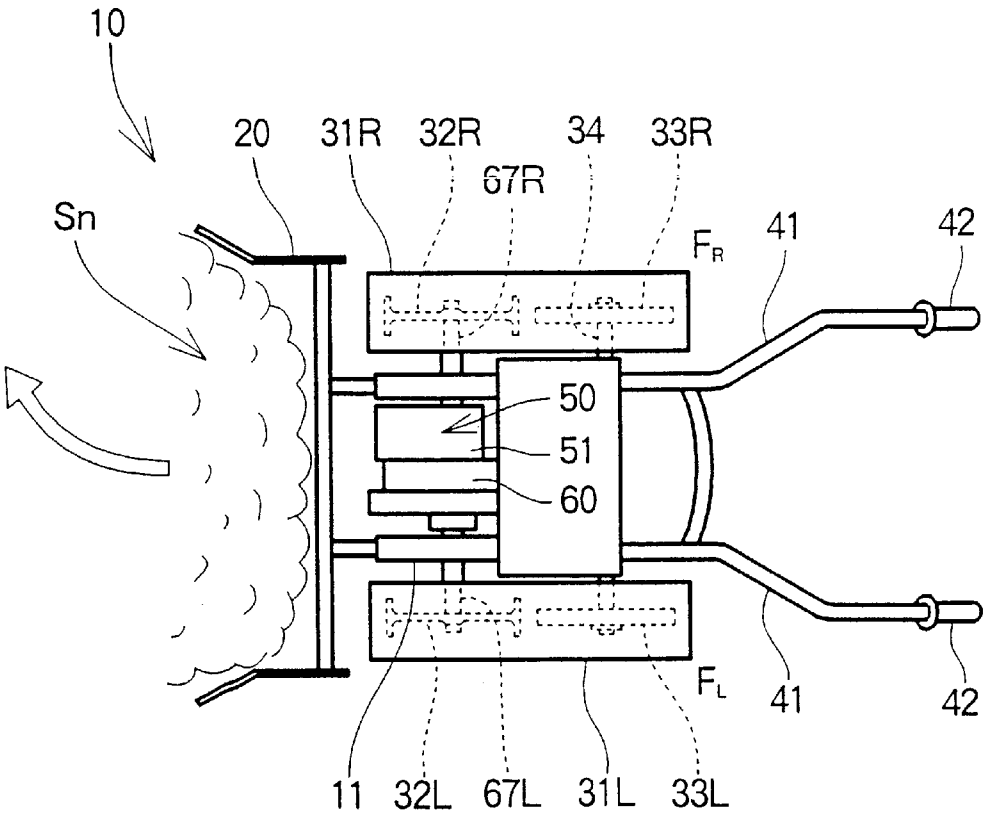
FIG. 13A is a top plan view showing an operation of the snow removal machine making a right turn.

FIG. 13A shows a state where the snow removing member 20 provided at the front of the vehicle pushes out snow Sn while the snow removal machine 10 is turning right, running. At that time, the right frictional resistance FR is larger than the left frictional resistance FL (FR>FL). That is, there occurs difference between the right and left frictional resistances FR, FL.

FIG. 13B shows the power transmission mechanism 60 and the surroundings in the state where the snow removal machine 10 is turning right as shown in FIG. 13A.

The fact FR>FL results in a larger driving force of the right driven bevel gear 74R than that of the left driven bevel gear 74L. Accordingly, the right and left drive bevel gears 73, 73 rotate about the pivot shaft 72 in directions of arrows y and y while revolving in a direction of arrow x. That is, the speed of the left drive wheel 32L is increased by the amount of the decreased speed of the right drive wheel 32R of a larger frictional resistance. This provides a rotational difference between the right and left drive wheels 32R, 32L to permit the snow removal machine 10 to run smoothly at the time of changing its direction.

Since the rotational speed NL of the left drive wheel 32L is larger than the rotational speed NR of the right drive wheel 32R (NR<NL), the running speed of the left crawler belt 31L is greater than that of the right crawler belt 31R. As a result, the snow removal machine 10 can easily turn to the right while running.

In the case where the snow removal machine 10 is turning to the left while running, FR<FL, which results in. the reverse function of the power transmission mechanism 60 of the function at the time of turning right as described above. The running speed of the right crawler belt 31R is greater than that of the left crawler belt 31L.

In summary, the differential gear 66 interposed between the right and left drive wheel axles 67R, 67L can absorb the difference in the rotational speeds NR, NL between the right and left drive wheels 32R, 32L when the running direction of the walking-type snow removal machine 10 is being changed or corrected. Accordingly, changing direction of the snow removal machine 10 is easy and requires less workload of the operator. Further, since the turning radius can be reduced, the turning performance of the snow removal machine 10 can be enhanced. The easy turning of the snow removal machine 10 enhances its operability and reduces labor. Thus the snow removing workability of the snow removal machine 10 is enhanced.

In the above embodiment of the present invention, the differential gear 66 may be of any type as long as it absorbs the difference in rotational speeds NR, NL between the right and left drive wheels 32R, 32L when the running direction of the walking-type snow removal machine 10 is changed or corrected, not being limited to the specific structure as shown in FIGS. 4 and 5. Further the differential gear 66 may be the one equipped with a limited slip differential.

Furthermore, the potentiometer 43, the operating lever 44, the brake lever 45 and the height adjusting lever mechanism 140 can be disposed on either side of the right and left grips 42, 42.

Obviously, various minor changes and modifications of the present invention are possible in the light of the above teaching. It is therefore to be understood that within the scope of the appended claims the invention may be practiced otherwise than as specifically described.

What is claimed is:

1. A snow removal machine comprising:

a body frame;

a snow removing member disposed at a front part of the body frame and having a snow removing surface for pushing snow over a working surface;

a pair of operating handles disposed at a rear part of the body frame;

a pair of coaxial drive wheel axles each mounted on a respective one of right and left sides of the body frame for undergoing rotation;

a pair of right and left drive wheels each mounted on a respective one of the drive wheel axles for rotation therewith;

a rolling wheel axle mounted on the body frame for undergoing rotation;

a pair of right and left rolling wheels each mounted on the rolling wheel axle and disposed on a respective one of the right and left sides of the body frame;

a first crawler belt disposed on the right side of the body frame and entrained around the right driving wheel and the right rolling wheel for rotation therewith;

a second crawler belt disposed on the left side of the body frame and entrained around the left driving wheel and the left rolling wheel for rotation therewith;

an electric motor mounted on the body frame for driving the right and left drive wheels to rotate the first and second crawler belts, the electric motor having a motor shaft having a center disposed above a center of the drive wheel axles and rearwardly of the snow removing member so that the center of the motor shaft and the center of the drive wheel axles lie on a straight line inclined toward the front part of the body frame;

a power transmission mechanism for transmitting power from the electric motor to the right and left driving wheels to rotate the first and second crawler belts; and a battery mounted on the body frame for supplying electrical power to the electric motor and disposed between the drive wheel axles and the rolling wheel axle.

2. A snow removal machine as set forth in claim 1; further comprising a control device for controlling the electric motor.

3. A snow removal machine according to claim 2; wherein the right and left drive wheels are disposed forwardly of the right and left rolling wheels toward the front part of the body frame.

4. A snow removal machine according to claim 3; wherein the electric motor has a center of gravity disposed proximate the center of the drive wheel axles.

5. A snow removal machine according to claim 4; wherein the battery has a center of gravity disposed rearwardly of the center of gravity of the electric motor toward the rear part of the body frame.

6. A snow removal machine according to claim 5, wherein the control device has a center of gravity disposed rearwardly of the center of gravity of the battery toward the rear part of the body frame.

7. A snow removal machine as set forth in claim 1; wherein a line extending across the body frame and the snow removing member passes through a central point of the snow removing surface of the snow removing member when the body frame is inclined relative to the working surface and the snow removing member engages the working surface.

8. A snow removal machine according to claim 7; wherein the central point of the snow removing surface is disposed at a center of a height of the snow removing member.

9. A snow removal machine as set forth in claim 1; further comprising a differential gear disposed between the drive wheel axles for absorbing a difference in rotational speed between the right and left drive wheels; and wherein the power of the electric motor is transmitted to the right and left drive wheels through the differential gear and the drive wheel axles.

10. A snow removal machine according to claim 1; wherein the power transmission mechanism is disposed alongside the drive wheel axles and proximate the electric motor.

11. A snow removal machine comprising:

a body frame having a first side and a second side opposite the first side;

a snow removing member mounted on the body frame across the first and second sides thereof for removing snow;

a pair of coaxial first wheel axles each mounted on a respective one of the first and second sides of the body frame for undergoing rotation;

a pair of drive wheels each mounted on a respective one of the first wheel axles for rotation therewith;

a second wheel axle mounted on the body frame for undergoing rotation;

a pair of rolling wheels each mounted on the second wheel axle and disposed on a respective one of the first and second sides of the body frame;

a first crawler belt disposed on the first side of the body frame and entrained around one of the driving wheels and one of the rolling wheels for rotation therewith;

a second crawler belt disposed on the second side of the body frame and entrained around the other of the driving wheels and the other of the rolling wheels for rotation therewith; and an electric motor mounted on the body frame for driving the drive wheels to rotate the first and second crawler belts, the electric motor having a motor shaft having a center disposed above a center of the first wheel axles so that the center of the motor shaft and a center of the second wheel axles lie on a straight line inclined toward the snow removing member.

12. A snow removal machine according to claim 11; further comprising a battery mounted on the body frame for supplying electrical power to the electric motor, the battery being disposed between the first wheel axles and the second wheel axle.

13. A snow removal machine according to claim 11; further comprising a power transmission mechanism for transmitting power from the electric motor to the driving wheels to rotate the first and second crawler belts, the power transmission mechanism being disposed alongside the first wheel axles and proximate the electric motor.

14. A snow removal machine according to claim 11; wherein the electric motor has a center of gravity disposed proximate the center of the first wheel axles.

15. A snow removal machine according to claim 14; further comprising a battery mounted on the body frame for supplying electrical power to the electric motor, the battery having a center of gravity disposed between the center of gravity of the electric motor and a first portion of the body frame opposite to a second portion of the body frame on which the snow removing member is mounted.

16. A snow removal machine according to claim 15; further comprising a control device for controlling the electric motor, the control device having a center of gravity disposed between the center of gravity of the battery and the first portion of the body frame.

17. A snow removal machine according to claim 11; further comprising a differential gear disposed between the first wheel axles for absorbing a difference in rotational speed between each of the drive wheels.

18. A snow removal machine comprising:

a body frame having a first side and a second side opposite the first side;

a snow removing member mounted on the body frame across the first and second sides thereof for removing snow;

a pair of coaxial first wheel axles each mounted on a respective one of the first and second sides of the body frame for undergoing rotation;

a pair of drive wheels each mounted on a respective one of the first wheel axles for rotation therewith;

a second wheel axle mounted on the body frame for undergoing rotation;

a pair of rolling wheels each mounted on the second wheel axle and disposed on a respective one of the first and second sides of the body frame;

a first crawler belt disposed on the first side of the body frame and entrained around one of the driving wheels and one of the rolling wheels for rotation therewith;

a second crawler belt disposed on the second side of the body frame and entrained around the other of the driving wheels and the other of the rolling wheels for rotation therewith;

an electric motor mounted on the body frame for driving the drive wheels to rotate the first and second crawler belts;

a battery mounted on the body frame for supplying electrical power to the electric motor to drive the drive wheels, the battery being disposed between the first wheel axles and the second wheel axle; and a differential gear disposed between the first wheel axles for absorbing a difference in rotational speed between each of the drive wheels when a running direction of the snow removal machine is changed during snow removal.

19. A snow removal machine according to claim 18; wherein the electric motor has a center of gravity disposed proximate a center of the first wheel axles.

20. A snow removal machine according to claim 18; wherein the battery has a center of gravity disposed between a center of gravity of the electric motor and a first portion of the body frame opposite to a second portion of the body frame on which the snow removing member is mounted.

* * * * *